US006098417A

United States Patent [19]

Garrett

[11] Patent Number: 6,098,417

[45] Date of Patent: Aug. 8, 2000

[54] FLUID CHILLING APPARATUS

[75] Inventor: Michael E. Garrett, Woking Surrey, United Kingdom

[73] Assignee: The BOC Group plc, Windlesham, United Kingdom

[21] Appl. No.: 09/199,088

[22] Filed: Nov. 24, 1998

[30] Foreign Application Priority Data

Nov. 26, 1997 [GB] United Kingdom ..... 97024935

[51] Int. Cl.[7] ..... F25D 3/08

[52] U.S. Cl. ..... 62/371; 62/293; 62/480; 62/294

[58] Field of Search ..... 62/293, 480, 294, 62/371

[56] References Cited

U.S. PATENT DOCUMENTS

| | | | |
|---|---|---|---|
| 5,331,817 | 7/1994 | Anthony | 62/5 |
| 5,372,017 | 12/1994 | Zorea et al. | 62/457.9 |
| 5,447,039 | 9/1995 | Allison | 62/293 |
| 5,692,381 | 12/1997 | Garrett | 62/60 |
| 5,692,391 | 12/1997 | Joslin, Jr. | 62/293 |
| 5,704,222 | 1/1998 | Hage et al. | 62/293 |
| 5,765,385 | 6/1998 | Childs | 62/293 |
| 5,845,501 | 12/1998 | Stonehouse et al. | 62/62 |
| 5,865,036 | 2/1999 | Anthony | 62/293 |
| 5,901,783 | 5/1999 | Dobak, III et al. | 165/164 |
| 5,946,930 | 9/1999 | Anthony | 62/293 |

*Primary Examiner*—Henry Bennett
*Assistant Examiner*—Mark Shulman
*Attorney, Agent, or Firm*—William A. Schoneman; Salvatore P. Pace

[57] ABSTRACT

A beverage chiller which chills the liquid through the desorption of gas from an adsorbent within a vessel, wherein the chiller comprises a plurality of heat transfer elements, formed of thermally-conductive material and in direct thermal contact with the adsorbent and adapted to transfer heat between the vessel walls and the adsorbent therein, and wherein the elements are configured so as to cooperate in use in order to conduct desorbed gas from the adsorbent to the vessel walls and thence along the vessel walls prior to its exit from the vessel. The chiller provides more effective heat transfer and fully utilizes the chilling capacity of the desorbed gas by channeling it to and along the vessel walls.

20 Claims, 2 Drawing Sheets

FLUID CHILLING APPARATUS

BACKGROUND OF THE INVENTION

This invention relates to an apparatus for chilling fluids, particularly but not exclusively canned or bottled beverages. More particularly, the present invention is directed towards a fluid chilling apparatus of the type in which the temperature reduction caused by the desorption of a gas from an adsorbent is used to chill a beverage, such as is disclosed in European patent number 0752564.

In known apparatus for chilling fluids, of the type disclosed in EP0752564, a chilling cartridge is in either direct or indirect thermal contact with the fluid to be chilled (that is, the cartridge is either immersed in the fluid, or forms part of the fluid container, or it is adapted to fit into a recess formed in the container wall, or to fit around the container). The cartridge comprises a sealed thin-walled vessel (the thinness being preferable to promote heat transfer) containing an adsorbent for receiving and adsorbing under pressure a quantity of gas. For example, the adsorbent is activated carbon and the gas is carbon dioxide. On breaking the vessel seal and releasing the pressure, the gas is desorbed, and the endothermic process of desorption of the gas from the adsorbent causes a reduction in the temperature of the adsorbent and of the desorbed gas. Because the cartridge is in thermal contact with the fluid, this reduction in temperature leads to heat transfer from the fluid, through the vessel wall, to the adsorbent and desorbed gas therein, which serves to chill the fluid.

It is known that most adsorbents are poor conductors of thermal energy. For example, activated carbon can be described as an amorphous material, and consequently has a low thermal conductivity even when tightly compacted. This is disadvantageous because poor heat transfer to the adsorbent in the center of the body of adsorbent in the vessel reduces the chilling rate and/or wastes the "chilling power" of the central adsorbent. Accordingly, a number of embodiments of heat transfer means are disclosed in co-pending U.S. patent application Ser. No. 09/002,478 which improve heat transfer between the center of the adsorbent and the vessel walls.

A further problem with conventional arrangements arises from the flow of desorbed gas. In the interest of maximizing the quantity of adsorbed gas in the adsorbent, it is desirable that the adsorbent be highly compacted. However, such compactness reduces the porosity of the body of adsorbent, and so tends to retard the rate of desorption from within the body of the adsorbent, which slows the rate of chilling of the fluid. Secondly, although part of the desorbed gas leaves the adsorbent adjacent the nearest wall, and then travels along the vessel walls to the exit valve, a significant portion also permeates through the adsorbent to the exit valve of the vessel without coming into contact with the vessel walls, and thus a significant amount of "chilling power" (in the desorbed gas lost in this way) is effectively wasted as "sensible heat".

SUMMARY OF THE INVENTION

The present invention provides a chiller for chilling a quantity of fluid comprising a thin-walled vessel for placement in thermal contact with the fluid to be chilled and containing an adsorbent for receiving and adsorbing under pressure a quantity of gas, in use the desorption of gas from the adsorbent causing a reduction in temperature of the adsorbent and of the desorbed gas, which temperature reduction is effective in use to chill the fluid, wherein the chiller comprises a plurality of heat transfer elements, formed of thermally-conductive material and in direct thermal contact with the adsorbent and adapted to transfer heat between the vessel walls and the adsorbent therein, and wherein the elements are configured so as to cooperate in use in order to conduct desorbed gas from the adsorbent to the vessel walls and thence along the vessel walls prior to its exit from the vessel.

Such an arrangement adds little complexity to the chilling cartridge (nor indeed to the manufacture thereof) but simultaneously provides both good thermal transfer between the adsorbent and the vessel walls (with which preferably, each heat transfer element is in direct contact) and thermal conductivity between the desorbed gas and the vessel walls, and also provides preferential pathways for the desorbed gas to travel to the vessel walls and along those walls before leaving the vessel. Accordingly, the heat transfer elements of the invention cooperate so as to permit relatively free passage of the gas on both desorption and adsorption, thus accelerating the chilling process and also the "loading" of the cartridge with gas—so permitting the cartridge manufacturing time to be reduced.

Preferably substantially all the heat transfer members are the same shape, and they may be configured such that they can be disposed in a stack, with successive elements at least partially nested within elements immediately preceding in the stack. With such a stack, the topmost element (or elements, depending on the degree of nesting) will normally have a slightly different shape, in order to "top off" the stack so that it fits within the vessel.

In a particularly suitable embodiment the heat transfer elements are frustro-conical, and preferably have a corrugated rim, so that they resemble in shape and configuration the paper cases commonly used in baking cup cakes (in the United Kingdom) or muffins (in the United States of America and Canada).

Such elements are of course usually circular, so as to fit snugly within the vessel, which itself is normally cylindrical. Such elements are used to manufacture a chilling cartridge in the following manner. Firstly, a layer of activated carbon particles is introduced into the empty vessel, then a heat transfer element "cup" is slid down into the vessel. As the "cup" is slid into the vessel, the corrugated sides fold and pucker. Then, a further layer of carbon is placed inside this "cup", to be followed by a further "cup", more carbon, and so on. As the stack of "cups" reaches the top of the vessel, a shorter "cup" or "cup" is added so as to "top off" the stack without requiring an excessively thick final layer of carbon and so that the folded wall of the topmost "cup(s)" does not project above the edge of the cartridge vessel. Finally, the pressure is applied to the stack within the vessel to compact the carbon in order to obtain the desired overall density of the carbon, the gas is introduced into the vessel under pressure for adsorption and the vessel sealed.

The valve by which desorbed gas leaves the vessel may be located adjacent the top of the stack or, more preferably, at the base of the stack, so as to maximize the distance along which the desorbed gas travels in close proximity to the vessel wall, and thus to optimize heat transfer therewith.

On breaking the vessel seal and thus releasing the pressure on the adsorbent, the gas is desorbed and travels along the flat portion of the heat transfer element, which form a rapid thermal conducting path between the relatively thin layers of carbon (preferably between about 5 mm and 10 mm, more preferably about 8 mm in thickness) and the vessel walls, whilst the folded and puckered corrugations of adjacent "cups" cooperate so as to provide passages for the desorbed gas to escape (and for the passage of gas to be adsorbed, on manufacturing the cartridge, of course). Moreover, the desorbed gas is constrained to flow along the crimped passages in the element rim which are adjacent the wall of the vessel, and thus heat transfer into the gas is promoted and consequently the chilling effect on the fluid is increased.

We have found that for a "cup" shaped heat transfer element the ideal range of diameter: rim height aspect ratio is between about 5:1 and about 5:4 (which ratios are intended to be equivalent to the aspect ratio of a paper cake case for a British cup cake and the aspect ratio of a British milk bottle top, respectively).

Preferably, the heat transfer elements are formed of a resilient, heat conducting material, such as a foil of aluminum, or of an alloy thereof, and are in the range of thickness' at which aluminum foil (or items made thereof) is/are readily available for domestic use (ie about 0.25 mm).

In certain applications it may be desirable to provide, in addition to the co-operating crimped rims of the heat transfer elements, channel means adapted to provide a preferential pathway for the desorbed gas along and adjacent to the wall of the vessel—to promote more rapid desorptions, for example. Those skilled in the art will appreciate that there are many ways by which such preferential pathways may be created, and thus many forms which the channel means might take: a perforated or porous tube may be inserted along one side of the vessel before filling with carbon and heat transfer elements; a similar insert may be used but withdrawn after the vessel is filled with adsorbent and "cups", leaving an open "channel" in the easily deformed stacked "cup" rims; a hole may be drilled through the compacted mass of carbon and heat transfer "cups", close to the vessel wall; or the vessel may be formed as a cylinder with a longitudinal or spiral bulge extending along the length of the vessel.

It will also be appreciated that the present invention also encompasses both a beverage container (bottle or can) comprising such a chiller, and a method of manufacturing such a chiller.

DETAILED DESCRIPTION OF THE INVENTION

Figure 1:
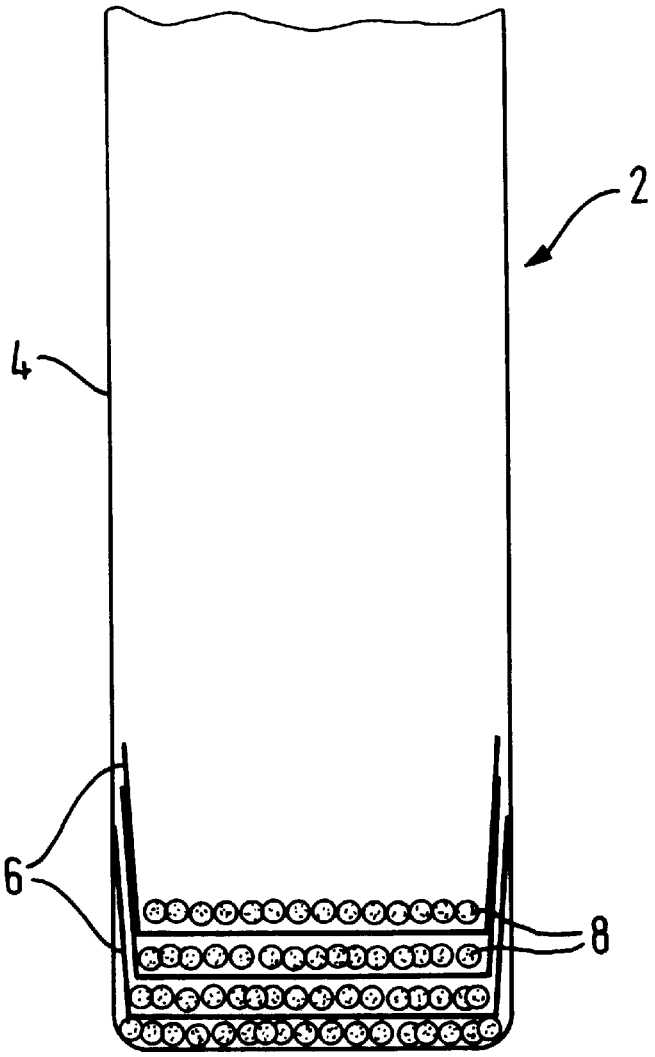
FIG. 1 is a partial schematic cross-sectional view of one embodiment of a fluid chiller cartridge in accordance with the invention.

An embodiment of a chiller in accordance with the invention will now be described by way of example and with reference to the accompanying drawings. The fluid chiller cartridge 2 shown (not to scale) in FIG. 1 comprises a thin-walled aluminum vessel 4, cylindrical in shape, containing a number of aluminum "cups" stacked within the vessel 4 with intervening layers 8 of carbon adsorbent. Each "cup" 6 (seen more clearly in FIG. 2) comprises a circular base section 10 and a tapering corrugated rim 12. The "cups" are sized relative to the vessel 4 so as to slide snugly therein, and so that the corrugations in the rim 12 of each "cup" is crimped, so that the rims of adjacent or contiguous "cups" cooperate, to provide passages for gas to travel into and from the layers 8 of adsorbent. The corrugated rim 12 of each "cup" is sufficiently resilient as to maintain good surface contact between the rims of adjacent "cups" and also between the extreme edge of each rim 12 and the walls of the vessel 4.

Figure 2:
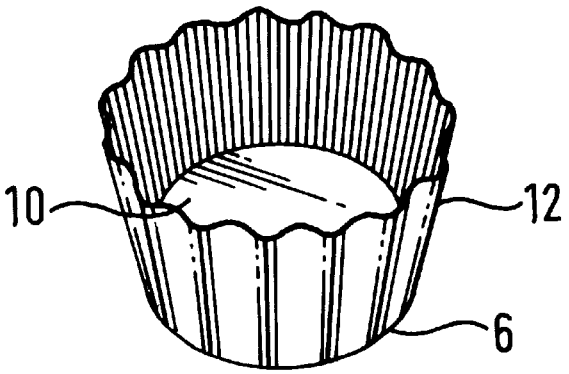
FIG. 2 is a schematic view of one of the heat transfer "cups" of the chiller of FIG. 1.

In use, the cartridge 2 shown in FIG. 1 (which for clarity is shown only partially filled; in use, the cartridge would be full of alternate layers of adsorbent and heat transfer "cups") would contain a quantity of gas under pressure and adsorbed by the adsorbent, and would be disposed in thermal contact with a container (not shown) of fluid to be chilled. To chill the fluid, a valve (not shown) would be opened, or the wall of the vessel 4 ruptured, so as to relieve the pressure on the adsorbent, thereby permitting desorption of the adsorbed gas. The valve could be located at the top of the stack (ie at the top of the vessel 4 shown in FIG. 1) or at the bottom of the stack; this latter is more preferable, as it increases the distance along which the desorbed gas must travel in close contact with the walls of the vessel 4, thus optimizing the heat transfer therebetween and the efficiency of chilling. The desorption process being endothermic, there is a significant temperature reduction in the carbon adsorbent and in the desorbed carbon dioxide gas. Heat is transferred from the fluid, via the walls of the vessel 4 and the heat transfer "cups" to the desorbed gas and also to the adsorbent, thereby chilling the fluid. The desorbed gas is able rapidly to move towards the walls of the vessel 4 and thence is constrained to move in close contact therewith, along the gas passages formed in the crimped corrugations, thereby promoting enhanced heat transfer so as fully to utilize the chilling effect of the desorption process.

Having described an embodiment of a fluid chiller cartridge in accordance with the invention which has significant functional advantages over conventional arrangements and also is both simple and inexpensive to manufacture, those skilled in the art will appreciate that there are several straight-forward modifications which could be made. For example, although the vessel illustrated in FIG. 1 is cylindrical, and of circular cross-section, there is no reason why the cross-section cannot be of a shape other than circular, and indeed it need not even be of constant shape along the length of the vessel. Furthermore, adsorbents other than activated carbon and gases other than carbon dioxide may be used. Also, the chiller may be adapted to fit releasably within a specially shaped recess in a beverage container (ie, not in direct thermal contact with the beverage) or it may simply be immersed in the beverage (and in direct thermal contact therewith). Although an embodiment is described and shown in which the heat transfer elements are "cup" shaped, these elements could equally be hemispherical, conical, box-shaped or indeed any shape which would enable them to form a nested stack.

Figure 3:
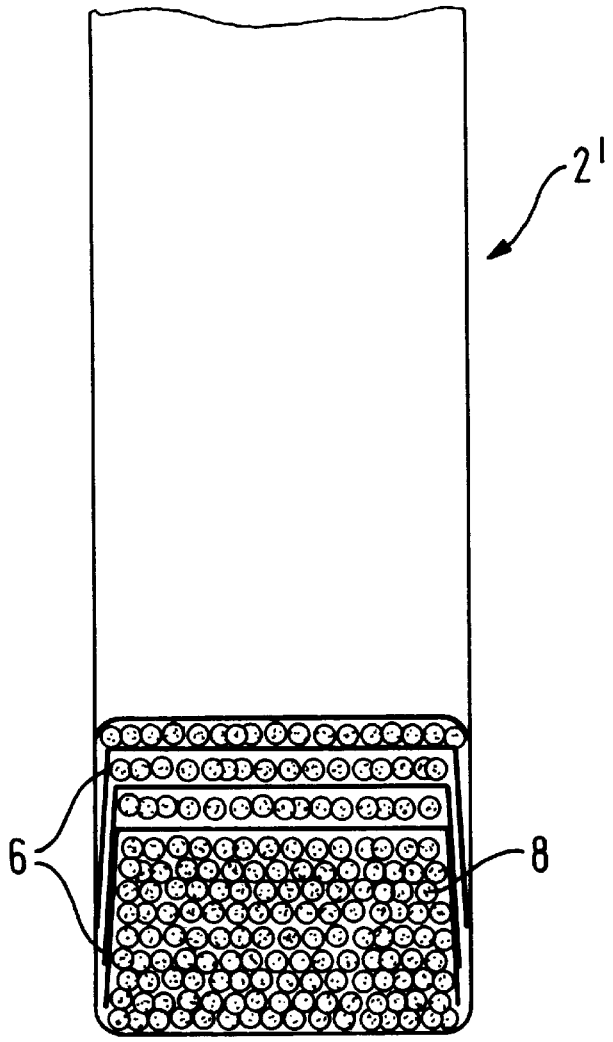
FIG. 3 is a schematic view of a second embodiment of a fluid chiller cartridge in accordance with the invention.
Figure 4:
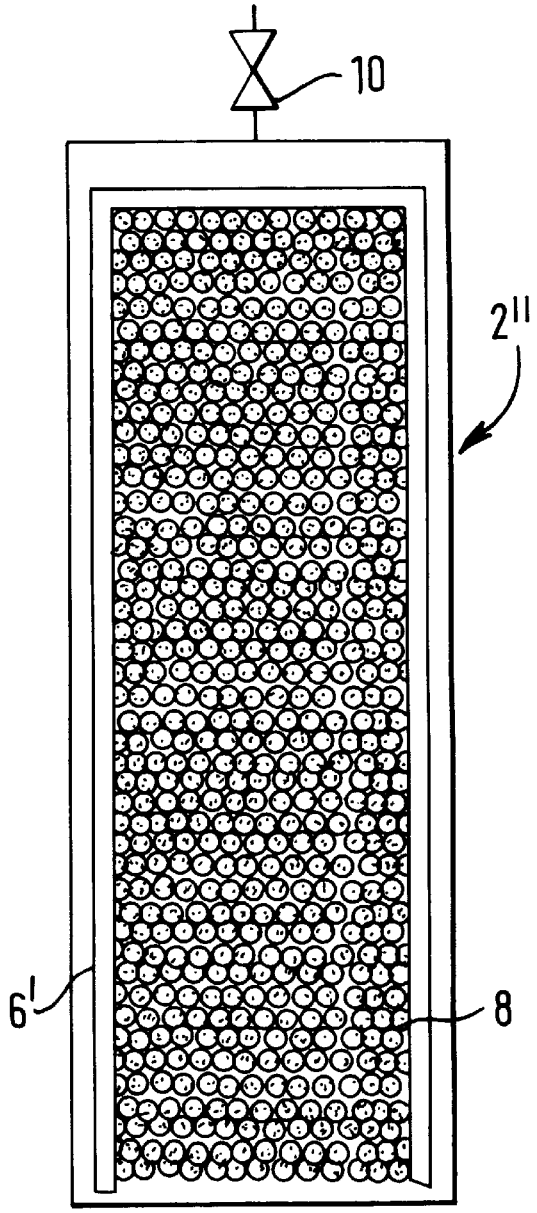
FIG. 4 is a schematic view of a fluid chiller cartridge having only a single heat transfer element.

The chiller 2' shown in FIG. 3 is very similar to that of FIG. 1, however the heat transfer "cups" 6 are inverted; with the valve (not shown) for the egress of desorbed gas at the top of the vessel as shown, the desorbed gas travels for the maximum distance in close contact with the walls of the vessel 4, thus optimizing heat transfer during chilling. As can be seen the use of but a single "cup" 6' in the chiller 2" of FIG. 4 will increase to the maximum the distance by which the desorbed gas will travel in contact with the walls of the vessel 4 before leaving via valve means 10 but at the cost of reducing the rates of gas desorption and of heat transfer to the center of the body of carbon adsorbent 8, although in practice these disadvantages might be addressed by providing gas channel means and/or heat transfer means, such as those disclosed in EP0752564 (or such as a cylindrical heat transfer element, disposed along the axis of the body of carbon adsorbent shown in FIG. 4).

It might equally be advantageous to provide separate valve means, for the egress of desorbed gas and for the ingress of the gas to be adsorbed, the 'egress' valve being located at the bottom of the stack so as to maximize the distance along which the gas must travel in close contact with the walls of the vessel before leaving, and the 'ingress' valve being located at the opposite end of the vessel, so as to minimize the distance traveled by the gas in close contact with the vessel walls before being adsorbed.

I claim:

1. A chiller for chilling a quantity of fluid comprising:

a thin-walled vessel for placement in thermal contact with the quantity of fluid to be chilled;

an adsorbent for receiving and adsorbing under pressure a quantity of gas wherein the desorption of gas from the adsorbent causes a reduction in temperature of the adsorbent and of the desorbed gas thereby chilling the quantity of fluid; and.

a plurality of heat transfer elements, formed of thermally-conductive material and in direct thermal contact with the adsorbent and adapted to transfer heat between the vessel walls and the adsorbent therein wherein the plurality of heat transfer elements are configured so as to cooperate in use in order to conduct desorbed gas from the adsorbent to the vessel walls and thereafter along the vessel walls prior to its exit from the vessel.

2. A chiller according to claim 1 wherein the plurality of heat transfer elements are all substantially the same shape.

3. A chiller according to claim 1 wherein successive heat transfer elements are stacked and are at least partially nested within the immediately heat transfer elements in said stack.

4. A chiller according to claim 1 wherein the heat transfer elements have a bottom that is substantially circular having a diameter and a conic, tapering rim having a height attached to said bottom.

5. A chiller according to claim 4 wherein the ratio of the diameter to rim height is between about 5 to 1 and about 5 to 4.

6. A chiller according to claim 4 wherein the rim is corrugated.

7. A chiller according to claim 3 wherein the heat transfer elements are stacked with a layer of adsorbent between adjacent elements, said layer being between about 5mm and about 10 mm in depth.

8. A chiller according to claim 7 wherein the layer of adsorbent is 8 mm in depth.

9. A chiller according to claim 1 further comprising a channel means adapted to provide a preferential path for desorbed gas along and adjacent to the wall of the vessel.

10. A chiller according to claim 1 wherein the heat transfer elements are formed of aluminum or an alloy thereof.

11. A chiller according to claim 1 further comprising a valve means for the egress of desorbed gas from the vessel wherein the valve means is located near the base of the stack.

12. A method of manufacture of a chiller comprising the steps of:

successively introducing adsorbent and a plurality of heat transfer elements into a thin-walled vessel so as to create a layered stack filling the vessel;

subjecting the stack to pressure in order to compress the adsorbent to a predetermined density; and, adding gas under pressure to be adsorbed by the adsorbent prior to sealing the vessel.

13. A method of manufacturing a chiller according to claim 12 wherein the plurality of heat transfer elements are of substantially the same of shape.

14. A method of manufacturing a chiller according to claim 12 wherein the plurality of heat transfer elements each have a substantially circular bottom having a diameter and an attached rim having a height.

15. A method of manufacturing a chiller according to claim 14 wherein the ratio of the diameter to the rim height is between about 5 to 1 and about 5 to 4.

16. A self-contained, self-cooling beverage can comprising an outer vessel for holding a quantity of beverage and a thin-walled inner vessel for placement in thermal contact with the quantity of beverage whereby the inner vessel contains an adsorbent for receiving and adsorbing a quantity of gas under pressure and a plurality of heat transfer elements formed of thermally-conductive material whereby said plurality of heat transfer elements are in direct thermal contact with the adsorbent and adapted to transfer heat between the inner vessel walls and the adsorbent and wherein said plurality of heat transfer elements are configured so as to cooperate in use in order to conduct desorbed gas from the adsorbent to the inner vessel walls and thence along the inner vessel walls prior to its exit from the inner vessel and the outer vessel.

17. A self-contained beverage can of claim 16 wherein said plurality of heat transfer elements are stacked one inside the other with a layer of the adsorbent between successive elements.

18. A self-contained beverage can of claim 16 wherein said plurality of heat transfer elements are substantially the same shape.

19. A self-contained beverage can of claim 18 wherein each of said plurality of heat transfer elements has a substantially circular bottom having a diameter and an attached rim having a height.

20. A self-contained beverage can of claim 19 wherein the ratio of said diameter to said rim height is between about 5 to 1 and about 5 to 4.

* * * * *